US005586873A

United States Patent [19]

Novak et al.

[11] Patent Number: 5,586,873

[45] Date of Patent: Dec. 24, 1996

[54] TUBE PUMP WITH RETRACTABLE ROLLERS

[76] Inventors: Pavel Novak, Stettemerstr. 117, CH-8207 Schaffhausen, Germany; Clemens Rebholz, Alte Uhldingerstr. 25, D-7772 Uhldingen/Mühlheim, Germany

[21] Appl. No.: 445,954

[22] Filed: May 22, 1995

Related U.S. Application Data

[63] Continuation of Ser. No. 363,590, Dec. 23, 1994, abandoned, which is a continuation of Ser. No. 77,779, Jun. 18, 1993, abandoned.

[30] Foreign Application Priority Data

Jun. 18, 1992 [DE] Germany ..... 42 20 119.5

[51] Int. Cl.[6] ..... F04B 43/08

[52] U.S. Cl. ..... 417/477.8

[58] Field of Search ..... 417/477.1, 477.8, 417/476, 474, 360, 361, 363

[56] References Cited

U.S. PATENT DOCUMENTS

| | | | |
|---|---|---|---|
| 1,848,024 | 3/1932 | Owen | 417/477 G |
| 2,696,173 | 12/1954 | Jensen | 417/477.6 |
| 3,463,092 | 8/1969 | Meyer | 417/477 G |
| 4,043,712 | 8/1977 | Azzolini | 417/477 G |
| 4,142,845 | 3/1979 | Lepp et al. | 417/477 |
| 4,548,553 | 3/1985 | Ferster | 417/477 G |
| 4,568,255 | 2/1986 | Lavender et al. | 417/477 G |
| 4,720,249 | 1/1988 | Krebs et al. | 417/477 G |

FOREIGN PATENT DOCUMENTS

| | | |
|---|---|---|
| 262890 | 12/1988 | Germany . |
| 91/16642 | 10/1991 | WIPO . |

*Primary Examiner*—Peter Korytnyk
*Attorney, Agent, or Firm*—Antonelli, Terry, Stout & Kraus

[57] ABSTRACT

A tube pump is disclosed for conveying liquid or viscous media, with a pump head on which at least two pump rollers are arranged, which rollers can be brought into engagement in succession with a tube wherein the medium to be conveyed is contained, in such a way that the medium is transported by squeezing the tube tightly. The tube pump according to this invention is distinguished in that the pump rollers can be shifted between two end positions, one of which positions (pumping position) permits the pumping operation and the other position (park position) permits a tube change without manual twisting of the pump head and without displacement of the tube bed.

6 Claims, 2 Drawing Sheets

TUBE PUMP WITH RETRACTABLE ROLLERS

This application is a continuation of application Ser. No. 08/363,590, filed Dec. 23, 1994, now abandoned, which is a continuation of application of Ser. No. 08/077,779, filed Jun. 18, 1993, now abandoned.

BACKGROUND OF THE INVENTION

The invention relates to a tube pump for the conveyance of liquid or viscous media.

Tube pumps are generally known and exhibit a pump head on which at least two pump rollers are arranged which can be brought into engagement in succsession with a turbo (pump hose) wherein the medium to be conveyed is contained, in such a way that the medium is transported by tight squeezing of the tube. As a consequence, tube pumps have the advantage that the conveyed medium comes exclusively into contact with the pump hose which latter can be exchanged in a relatively simple manner.

Thus, tube pumps are suited, for example, for transporting sterile solutions. It is merely necessary for this purpose to utilize sterilized pump tubes and/or tube kits which can be designed as disposable articles as well as in the form of repeatedly usable kits.

In the conventional tube pumps, the pump head is normally designed as a swivel plate, the individually rotatable rollers being arranged along the circumference thereof. The rollers squeeze the pump tube tightly and thus convey the liquid present therein according to the peristaltic pump principle.

A distinction is made between two subordinate kinds in tube pumps of this type:

The first subgroup exhibits a fixed tube bed against which the tube is pressed by the rollers which latter can be mounted either resiliently or fixedly. Normally, the rollers exert pressure radially toward the outside; however, there are also special models wherein the tube bed is located within the roller rim. For purposes of insertion, the tube must either be urged or pulled in between the rollers and the tube abutment by manually twisting the pump head, for example; or the tube bed must be removable or displaceable.

In the second subgroup, the pump tube is tensioned against the rollers. In order to obtain adequate occlusion (i.e. tight squeezing of the tube in the region of the rollers), usually at most three rollers can be utilized in such a structure. Additionally, due to the tensioning step, the tube cross section is reduced and/or flattened so that the maximally feasible throughflow efficiency is reduced.

Both subordinate types have the drawback that insertion of the pump tube is either very troublesome and requires great manual skill, or the tube bed must be removed or displaced in order to insert the tube.

SUMMARY OF THE INVENTION

The invention Is based on the object of further developing a tube pump for conveying liquid or viscous media in such a way that the insertion of the tube is simplified without having to remove a possibly present tube bed or to twist the pump head.

According to the invention, the pump rollers are displaceable between two end positions, of which one position (pumping position) permits the pumping operation and the other position (park position) permits changing of the tube without manual twisting of the pump head and without displacement of the tube bed.

The tube pump of the present invention operates, in particular, with a locally fixed tube bed but with displaceable, e.g. lowerable rollers.

It is thus possible to arrange the entire pump head in the front panel of the device in hidden fashion. On the one hand, this permits optimal integration into the front panel of the device; on the other hand, the pump tube can yet be exchanged in a simple way by the operator.

The tube pump of this invention furthermore provides the feature that the pump rollers can be pulled from the operative position into a park position by simply depressing a release button. Thereby, the tube obtains sufficient clearance for being exchangeable in a simple way. Furthermore, a mechanism is included which, after restarting the pump head, brings about an automatic adjustment into the operative position.

An additional improvement of the delivery constancy is possible by a structural feature compensating for fluctuations in the tube wall thickness. For this purpose, the provision is made to mount the pump rollers in resilient fashion.

BRIEF DESCRIPTION OF THE DRAWINGS

The invention will be described below, without limiting the general idea of the invention, by way of example, using embodiments with reference to the drawing which latter is otherwise expressly referred to regarding the disclosure of all details of the invention not elaborated on in the text. In the drawing.

DETAILED DESCRIPTION OF THE PREFERRED EMBODIMENTS

Figure 1A:
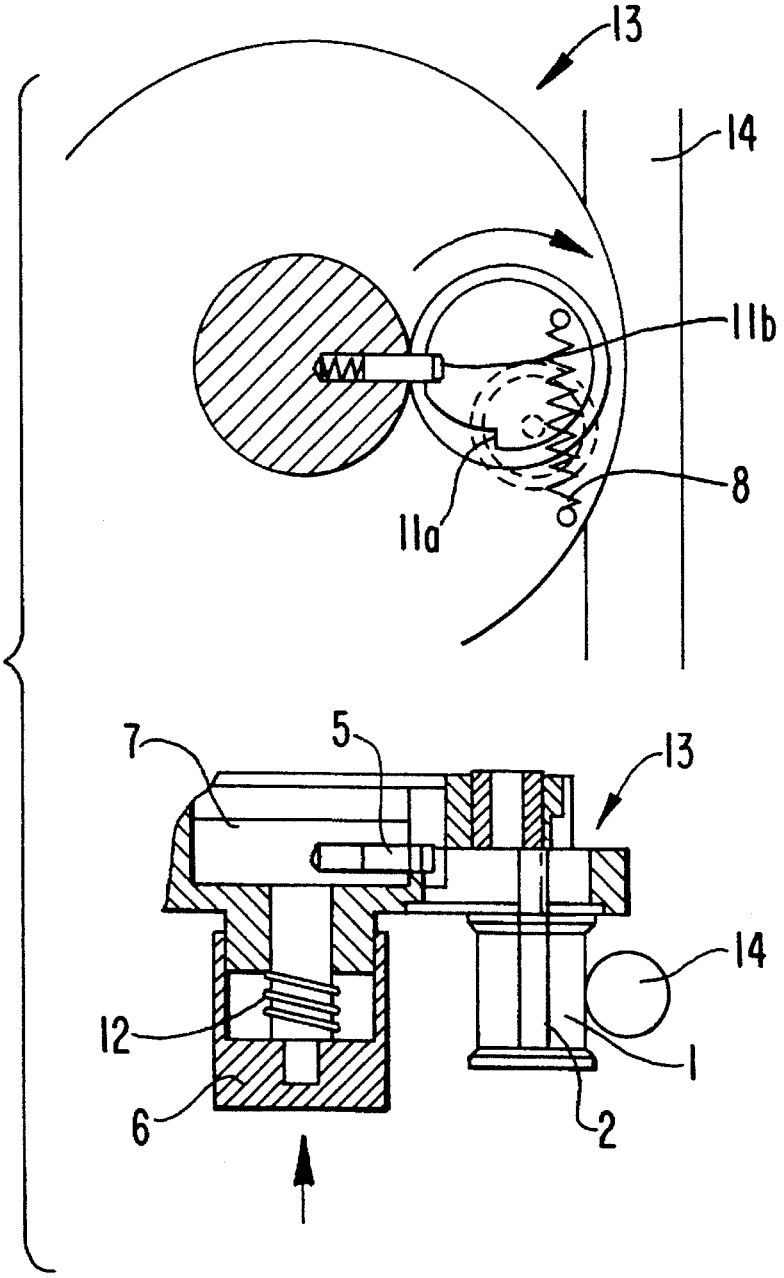
FIG. 1*a* shows, in a top view and in a partially sectional view, a tube pump according to this invention in pumping operation.
Figure 1B:
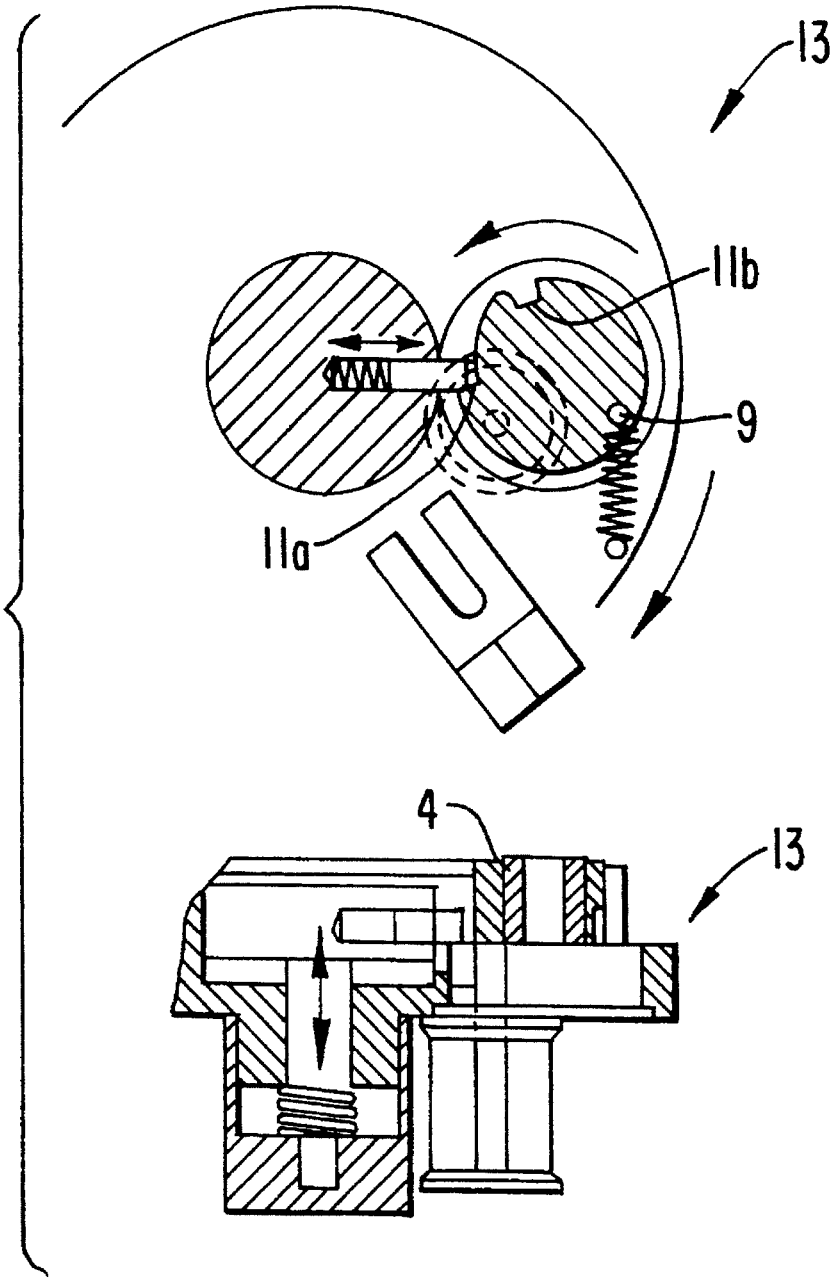
FIG. 1*b* shows corresponding views of a tube pump in the park position.

Pump rollers 1, only one of which is illustrated in the drawing, are centrally supported to be rotatable on shafts 2. The shafts 2 are arranged eccentrically in respective eccentric disks 3. The eccentric disks 3 are mounted centrally to be rotatable in an eccentric disk mounting 4.

In case the arrangement is in the position wherein pumping operation is possible (illustration part a), the eccentric disk 3 is fixed by means of notch 11*b* in the corresponding end position through locking pin 5 axially resiliently supported in a release disk 7.

For removal of the tube, the release button 6 is depressed; thereby, the release disk 7 with the locking pin 5 is shifted axially, thus eliminating the fixed retention of the eccentric disk 3. Owing to the force of a tension spring 8 tensioned between the eccentric disk 3 and the centric disk mounting 4, the eccentric disk 3 is turned so that the pump roller move in the direction of the center of the pump head and thus releases the tube.

The position of the arrangement in the park condition is defined by the second extreme location of the notche 11*b*, engaged by the locking pin 5 due to the spring 12.

The locking procedure, i.e. the extension of the rollers into the outer position takes place automatically after startup of the pump head, in that a pin 9 mounted to the rear side of the eccentric disk approaches the eccentric rocker arm 10 and, by traveling along this rocker arm, turns the eccentric disk backwardsto such an extent that the locking pin 5 reenters the. corresponding notch 11*b* of the eccentric disk. This notch (milled-in portion) in the eccentric disk is optimized so that the locking pins, on the one hand, can optimally slide out of the locking notch and, on the other hand, can again slide into the region of the eccentric disk after the lowering of the rollers into the "park position" (by spring force). Finally, a corresponding shape (rounding) of the locking notch 11*b* takes care of performing the final part of the rotating movement of the eccentric disks during the locking step by means of the locking pin (spring of the locking pins) rather than by way of the guide pin 9. This ensures that, in the locked condition, the eccentric pins travel past the eccentric rocker arm 10 without contact. The jumping back of the release disk 7 into the initial position wherein the eccentric disks are sealed likewise takes place with spring force 12.

In addition, it would be possible from a structural viewpoint to anchor the roller axles 2 within the eccentric disks 3 in a resilient fashion and thereby to design the rollers to be individually resilient in order to compensate for fluctuations of the pump tube wall thickness.

Upon startup of the pump head after a tube change, the operation position is automatically restored, in that the guide pin 9 on the rear side of the eccentric disk 3 engages into the eccentric rocker arms 10 and roll along therein. Thereby, the eccentric disk 3 is rotated backwards again to such an extent that the locking pin 5, axially pretensioned by the spring 12, can lock into the corresponding location of the notch 11*b*. By a suitable round configuration of the notch 11*b*, it is finally, ensured that the final segment of the rotary movement during locking into the operative position is not brought about by the guidance of the guide pin 9 in the rocker arms 10 but rather by the axial Spring pressure on the locking pin 5. This makes sure that, during operation, no tontact is possible between guide pin 9 and eccentric rocker arm 10.

We claim:

1. Tube pump for conveying liquid or viscous media, comprising a pump head on which at least two pump rollers are arranged which latter can be brought into engagement in succession with a tube wherein the medium to be conveyed is contained, in such a way that the medium is transported by squeezing the tube tightly, wherein the pump rollers are displaceable between two end positions, of which one position, pumping position, permits the pumping operation and the other position, park position, permits changing of the tube without manual twisting of the pump head and without displacement of the tube bed; and a first mechanism which unlocks the pump rollers which are in the pumping position, so that these pump rollers can be converted into the park position, wherein the first mechanism comprises an eccentric disk for each pump roller, this disk being supported in an eccentric disk mounting to be rotatable about an axis, a shaft of the respective pump roller being mounted on this disk eccentrically to the axis, and a release button displacing a release disk in such a way that locking pins supported therein overcome the locking of the eccentric disks so that tension springs tensioned between the eccentric disks and the eccentric disk mounting pull the eccentric disks with the pump rollers supported therein into the park position.

2. Tube pump according to claim 1, characterized in that a further mechanism is provided executing the reentrance of the pump rollers from the park position into the pumping position.

3. Tube pump according to claim 2, characterized in that the further mechanism exhibits guide pins attached to the rear side of the eccentric disks, these guide pins, after startup of the pump head, engage into the eccentric rocker arms, travel along therein, and turn the eccentric disks backwards to such an extent that, due to the spring force of a spring, the locking pins slide into the notches of the eccentric disks until the pumping operation position has again been attained.

4. Tube pump according to claim 3, characterized in that the configuration of the notches is such that contact between the guide pins and the eccentric rocker arms during operation is prevented.

5. Tube pump according to claim 3, characterized in that the notches in the eccentric disks are of such a configuration that, during locking into the pumping position, the final segment of the rotary movement of the eccentric disks is brought about by the collaboration of the axially pretensioned locking pins and the correspondingly rounded notches.

6. Tube pump according to claim 1, characterized in that the roller shafts are resiliently supported on the eccentric disks.

* * * * *